United States Patent [19]

Yuasa et al.

[11] Patent Number: 4,717,861

[45] Date of Patent: Jan. 5, 1988

[54] ELECTRONIC FLASH DEVICE

[75] Inventors: Yoshio Yuasa, Osaka; Kazuhiko Naruse, Nabari; Masahito Inaba, Ikeda, all of Japan

[73] Assignee: Minolta Camera Kabushiki Kaisha, Osaka, Japan

[21] Appl. No.: 840,610

[22] Filed: Mar. 17, 1986

Related U.S. Application Data

[63] Continuation of Ser. No. 511,509, Jul. 5, 1983, Pat. No. 4,608,522.

[30] Foreign Application Priority Data

Jul. 6, 1982 [JP] Japan ..... 57-118243
Sep. 18, 1982 [JP] Japan ..... 57-162831

[51] Int. Cl.[4] ..... H05B 41/34

[52] U.S. Cl. ..... 315/241 P; 315/200 A; 315/323; 315/324; 315/232; 354/419; 354/132; 354/145.1

[58] Field of Search ..... 315/241 P, 200, 232, 315/323, 324, 241 R, 200 A, 241 S; 354/419, 132, 145.1, 402

[56] References Cited

U.S. PATENT DOCUMENTS

| | | | |
|---|---|---|---|
| 3,821,750 | 6/1974 | Murakami et al. . | |
| 3,940,659 | 2/1976 | Kojima et al. | 315/241 P |
| 3,953,763 | 4/1976 | Herrick | 315/241 S |
| 3,978,370 | 8/1976 | Stieringer | 315/151 |
| 4,143,955 | 3/1979 | Matsumoto | 354/34 |
| 4,228,381 | 10/1980 | Hasegawa | 315/151 |
| 4,246,514 | 1/1981 | Metzger | 315/241 P |
| 4,344,020 | 8/1982 | Horinishi | 315/241 P |
| 4,393,335 | 7/1983 | Hirata et al. | 315/241 P |

FOREIGN PATENT DOCUMENTS 56-16115 2/1981 Japan .

*Primary Examiner*—Leo H. Boudreau
*Assistant Examiner*—Michael Razavi
*Attorney, Agent, or Firm*—Price, Gess & Ubell

[57] ABSTRACT

An electronic flash device fires one or a pair of flash tube sequentially for continuous shooting photography with a motor driven photographic camera, for substantially continuous illumination or for sequential illuminations at intervals, as well as fire the flash tube a single time for one shot photography. The flash device is provided with a main capacitor and an auxiliary capacitor which selectively energize the flash tube or tubes. The auxiliary capacitor is charged by the main capacitor and discharged to energize the flash tube for a small amount of flash light and short-time restoration of the flash firing circuit. When a pair of flash tubes are employed, they are alternatively actuated for the sequential firing and one of them is actuated for the single time firing. The pair of flash tubes are coupled with each other through a commutation capacitor and switch elements for quick repetition of their firings.

3 Claims, 14 Drawing Figures

JF2
JF3
JF1
JB1
JB2
JB3
Sx
AN1
BT7
BT8
C20
C21
C22
BT6
BT5
BT4
RT3
AC1
VE
C10
BT3
C9
C8
BT2
BT1
BT9
R12
R13
R14
C7
ZD3
Sw CKT.
R8
R16
SR4
SC3
C4
R7
XC
SR3
C5
CS
TR
R6
C2
C3
L
R4
SR2
SC1
R3
SC2
CM
4
DC/DC
BA
SW1
6
Line Sensor
Line Sensor Control
8
AC2
CE1
PT4
R20
10
S-H
12
A-D
14
Micro-Com I
16
OSC
18
Micro-Com II
Motor Drive
22
Indicator
20
Lens Drive
24

ELECTRONIC FLASH DEVICE

This is a continuation of application Ser. No. 511,509, filed July 5, 1983, now U.S. Pat. No. 4,608,522.

BACKGROUND OF THE INVENTION

1. Field of the Invention

The present invention relates to an electronic flash device, although not limited to such a device, for use with a photographic camera or for use in a photographic enlarger, and more particularly, relates to such an electronic flash device which is capable of single firing and successive multiple firings of one or more flash tubes.

2. Description of the Prior Art

When used with a photographic camera, the electronic flash device is required to emit a flash light not only a single time in each single-shot picture taking operation but also sequentially or successively in synchronization with successive photography for continuous shooting with a motor driven camera. The electronic flash may also be required to emit flash light successively for the purpose of illuminating an object to be photographed such that focusing of the camera objective lens can be adjusted automatically or manually with the aid of the flash light illumination or that the camera user can observed the lighting condition. It is further desirable if the electronic flash can also be used as a stroboscope for illuminating an moving object to be photographed so that successive stages of the movement can be recorded on a single picture frame. When the electronic flash device is used in a photographic enlarger as its light source, it is desirable that the electronic flash devic emits a large amount of light at successive intervals for the exposure as well as a small amount of light successively at such a high frequency as to be regarded as continuously emitted, for the purpose of focusing, trimming and adjustment of enlarging multiplication.

U.S. Pat. No. 4,275,335 assigned to the same assignee as that of the present invention, discloses an electronic flash device which can emit a large amount of flash light for a single-shot picture taking as well as emit a small intensity of flash light continuously prior to an actual photography. However, the prior art device can not emit flash light successively at intervals.

U.S. Pat. No. 4,210,849 assigned to the same assignee, discloses an electronic flash device wherein the amount of light emitted therefrom can be limited so that the main capacitor of the device can be recharged to a desired level during the interval of successive photography for continuous shooting with a motor-driven camera. However, the device can not emit flash light successively at high frequency, because it takes considerable time for resetting the flash firing circuit.

Japanese laid-open patent application with laid-open No. Sho 50-134,636 shows an electronic flash device with a pair of flash tubes which are alternatively fired at a high frequency. However, the device can not make a single firing.

SUMMARY OF THE INVENTION

Accordingly, an object of the present invention is to provide an electronic flash device suitable for flash light emission not only for a single time but also successive multi times at intervals.

Another object of the present invention is to provide an electronic flash device for use with a photographic camera and which is suitable for flash light-emission at a single time for a single shooting as well as at successive multi times for a continuous shooting.

Still another object of the present invention is to provide an electronic flash device which emits flash light at a single time as well as successively at such a high frequency as to illuminate an object substantially continuously.

Yet another object of the present invention is to provide an electronic flash device for use as a light source of a photographic enlarger and which can emit a large amount of flash light at intervals as well as a small amount of light successively at a high frequency so as to provide a continuous illumination effect.

A further object of the present invention is to provide an electronic flash device which is provided with at least a pair of flash tubes and which fires one of the pair a single time and fires both of the pair alternatively.

A still further object of the present invention is to provide an electronic flash device including four flash tubes and which is capable of actuating three of them successively at intervals in one occasion and actuates the remaining one and one of the three alternatively in an other occasion.

Yet a further object of the present invention is to provide an electronic flash device wherein a flash tube is energized selectively by two capacitors of different capacities for a large amount of light emission and a small amount of light emission.

An even further object of the present invention is to provide an electronic flash device including a main capacitor and an auxiliary capacitor and wherein the auxiliary capacitor is charged by the main capacitor and energizes a flash tube for quick response to a high speed continuous shooting, the main capacitor directly energizing the flash tube in another occasion for a single shooting.

The above and further object and feature of the present invention will appear more fully hereinafter from a consideration of a following description taken in connection with the accompanying drawings wherein:

DETAILED DESCRIPTION OF THE PREFERRED EMBODIMENTS

Figure 1:
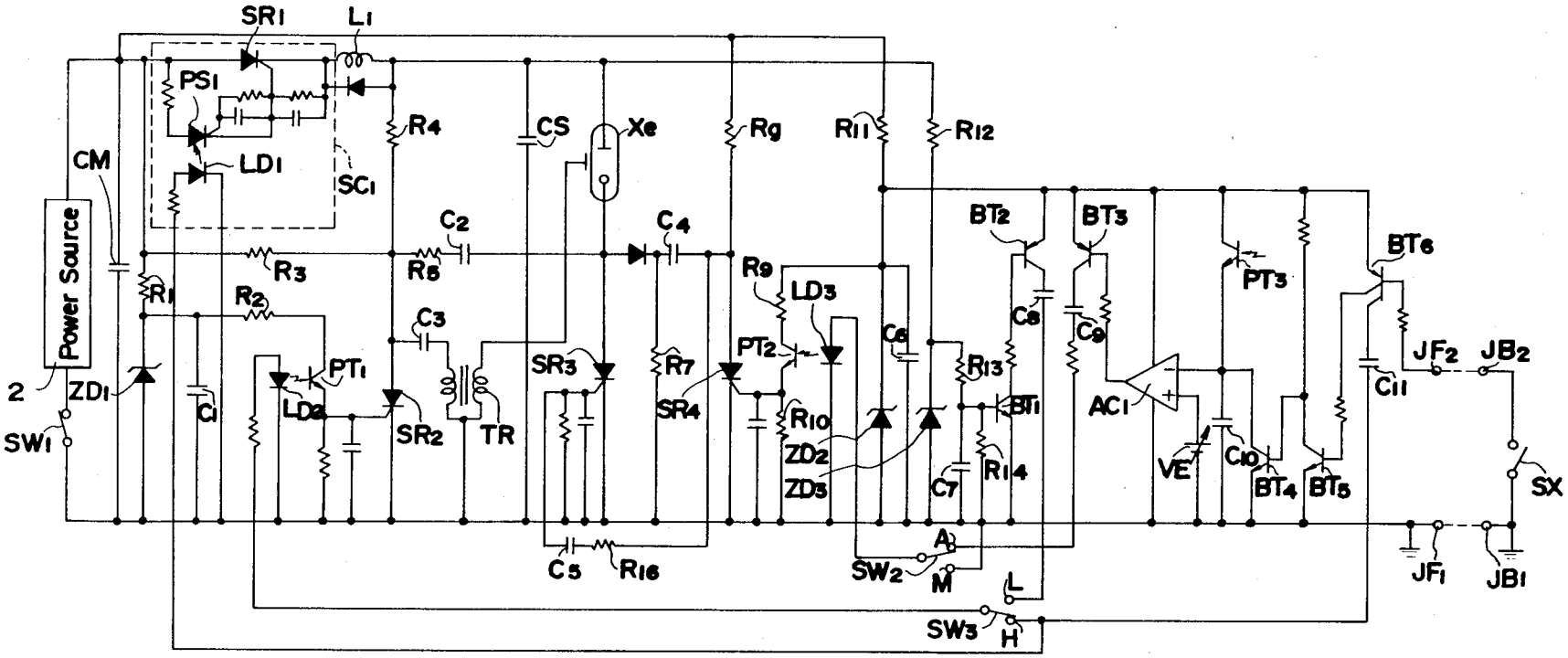
FIGS. 1 and 2 are circuit diagrams showing respectively first and second embodiments according to the present invention.

In the embodiment of FIG. 1, the present invention is applied to an electronic flash device for illuminating a scene or object to be photographed. The electronic flash device is designed such that a flash tube emits either a large or a small amount of flash light one time singularly in response to the closure of a synchro switch in the camera. When pictures are taken successively at a high frequency with the camera being driven by an electric motor for the film wind-up and shutter cocking, the flash device emits a small amount of flash light in synchronization with the camera operation. With reference to FIG. 1, power source circuit 2 includes a power source battery and a DC-DC converter which boosts the voltage of the battery to the desired high voltage e.g. 300 V. So long as the power switch SW1 is closed, the power source circuit 2 continues supplying the boosted high voltage to the main capacitor CM and described the same. The Xenon tube Xe is energized by the main capacitor CM or the later-to-be-described auxiliary capacitor CS to emit flash light thereby discharging the capacitor.

A trigger circuit for triggering the firing of Xenon tube Xe comprises the resistor R1 and Zener diode ZD1 serially connected across main capacitor CM; capacitor C1 connected across the Zener diode ZD1, to be charged thereby to the voltage thereacross; light emitting diode LD2; phototransistor PT1 designed to receive the light from the light emitting diode LD2; thyrister SR2; trigger capacitor C3; and trigger transformer TR. When the light emitting diode LD2 is energized by a synchro switch closure signal or the output of a delay circuit composed of resistors R13 and C7 the phototransistor PT1 conducts it to discharge capacitor C1 and make the thyrister SR2 conductive, so that the trigger capacitor C3 is discharged, resulting in high voltage at the secondary coil of the trigger transformer TR. This high voltage is applied to the Xenon tube Xe to trigger the latter.

Auxiliary capacitor CS, which also stores electric energy to trigger the Xenon tube Xe has a smaller capacity than main capacitor CM. A switching circuit SC1 and a inductance element L1 are serially connected between a main and auxiliary capacitors CM and CS. Switching circuit SC1 includes a light emitting diode LD1 which emits light in response to a synchro switch closure signal as described later, photothyrister PS1 which is designed to receive the light from the light emitting diode LD1 and conducts in response thereto, and the thyrister SR1 which is made conductive by the conduction of photothyrister PS1. When the thyrister SR1 conducts, a resonance circuit is formed by the thyrister SR1, inductance element L1 and main capacitor CM which rapidly charges the auxiliary capacitor CS using the charge of the main capacitor CM until the completion of the charging when the thryster SR1 is reverse biased between its anode and cathode and is made non-conductive to block the discharge path from the main capacitor CM to the auxiliary capacitor CS and the Xenon tube Xe.

The resistor R12 and Zener diode ZD3 are serially connected across the auxiliary capacitor CS. When the charging of the auxiliary capacitor CS has been completed, a voltage occurs across the Zener diode ZD3 and the voltage is applied to a delay circuit composed of resistors R13 and R14 and a capacitor C7. When the capacitor C7 is charged to a given level after a given delay time, transistors BT1 and BT2 are rendered conductive and in turn energize the light emitting diode LD2 by means of the discharge current of the capacitor C8 through terminal L of the selection switch SW3 and the trigger Xenon tube Xe. The phototransistor PT3 forms a light measuring circuit along with capacitor C10, comparator AC1 and others. Phototransistor PT3 is arranged to receive light reflected from an object to be photographed and to generate photoelectric current commensurate with the object light brightness. The photoelectric current is integrated by capacitor C10. The switching transistor BT4 is connected with capacitor C10 and is made conductive to initiate the integration by capacitor C10 when the synchro switch SX of the camera is closed to render transistors BT6 and BT5 conductive. The comparator circuit AC1 compares the charge voltage of capacitor C10 with reference voltage $V_E$ and inverts its output to render transistor BT3 conductive when the integration capacitor C10 is charged to a given level. Then, capacitor C9 is discharged through conductive transistor BT3 and energizes the light emitting diode LD3 through terminal A of the selection switch SW2. Thyristers SR3 and SR4, resistors R7 and R16 and capacitors C4 and C5 together form a light extinguishing circuit for interrupting the firing of the Xenon tube Xe. When the Xenon tube Xe is triggered as described above, a trigger voltage is applied to the gate of thyrister SR3 through capacitors C4 and C5 and resistors R16 to render thyrister SR3 conductive and fire or ignite the Xenon tube Xe. The phototransistor PT3 receives the light reflected from an object which is being illuminated by the Xenon tube Xe. When the light emitting diode LD3 is energized as described above, the phototransistor PT2 receives the light of the light emitting diode LD3 and conducts it to cause a voltage across resistor R10. The voltage renders thyrister SR4 conductive so that thyrister SR3 is reverse biased by a pre-charged capacitor C4 through thyrister SR4 and is rendered non-conductive to interrupt the firing of Xenon tube Xe.

Selection switch SW2 is selectively connected with automatic terminal A for automatically controlling the amount of light emitted from the Xenon tube Xe as described above, and with manual terminal M for short-circuiting the light emitting diode LD3 and disconnecting the latter from the light measuring circuit so that the Xenon tube Xe may be fired fully without being interrupted by the light of light emitting diode, until main capacitor CM or auxiliary capacitor CS has been fully discharged. The selection switch SW3 is selectively connected with terminal H for providing a large amount of flash light emission due to the discharge of main capacitor CM and with terminal L for providing a small amount of flash light emission due to the discharge of auxiliary capacitor CS. Both switches SW2 and SW3 are linked with each other to be respectively simultaneously connected with terminals A and H, M and H and M and L but not with A and L.

The operation of the above described circuitry will now be described. Assume that switch SW2 is connected with terminal M while switch SW3 is connected with terminal L. When the synchro switch Sx of the camera is closed upon full opening of the camera shutter, transistor BT6 is made conductive to energize the light emitting diode LD1 by the discharging of capacitor C11 so that the phototransistor conducts to render thyrister SR1 conductive. The conduction of thyrister SR1 forms the resonant circuit of thyrister SR1, inductance element L1 and main capacitor CM so that the charge of the main capacitor CM is rapidly charged in auxiliary capacitor CS until the anode-cathode of thyrister SR1, is reverse-biased and the thyrister is blocked. When the auxiliary capacitor CS has been charged to a given voltage, the Zener diode ZD3 generates a voltage of a given level which actuates the delay circuit of capacitor C7 and resistors R13 and R14. After the lapse of a delay time determined by the capacitance of capacitors C7 and the resistances of resistors R13 and R14, transistors BT1 and BT2 are rendered conductive to discharge capacitor C8 through switch SW3 and energize the light emitting diode LD2, thereby rendering thyrister SR2 conductive. As the result, the voltage across Xenon tube Xe is raised through resistor R5 and capacitor C2 to facilitate the firing of the Xenon tube Xe. Additionally, the conduction of thyrister SR2 actuates the trigger circuit to trigger, and conduct to the Xenon tube Xe. With this, a trigger voltage is applied to the gate of thyrister SR3 which is rendered conductive. When the auxiliary capacitor CS is fully discharged, the Xenon tube Xe ceases firing.

Next, explanation will be given for the case where switch SW2 is connected with automatic terminal A and switch SW3 is connected with terminal H. In this case, when synchro switch Sx is closed, both light emitting diodes LD1 and LD2 are energized to cause conduction of thyrister SR1 and firing of Xenon tube Xe simultaneously. Phototransistor PT3 detects the light from an object to be photographed and being illuminated by the light from Xenon tube Xe. The photoelectric current generated by phototransistor PT3 is integrated by capacitor C10. At that time, as thyrister SR1 is not reverse biased between its anode and cathode and remains conductive, the Xenon tube Xe is energized by the main capacitor CM. When the charged voltage of integrating capacitor C10 reaches a level determined as a function of a set film sensitivity, the output of comparator AC1 turns to a "Low" level to render transistor BT3 conductive and energizes the light emitting diode LD3 which makes thyrister SR4 conductive so that the voltage of capacitor C4 blocks thyrister SR3 and interrupts the light emission of the Xenon tube Xe.

When the switch SW2 is connected with terminal M and switch SW3 with terminal H, the Xenon tube Xe is energized by the main capacitor CM and emits light continuously until the charge in main capacitor CM has been fully consumed.

Figure 2:
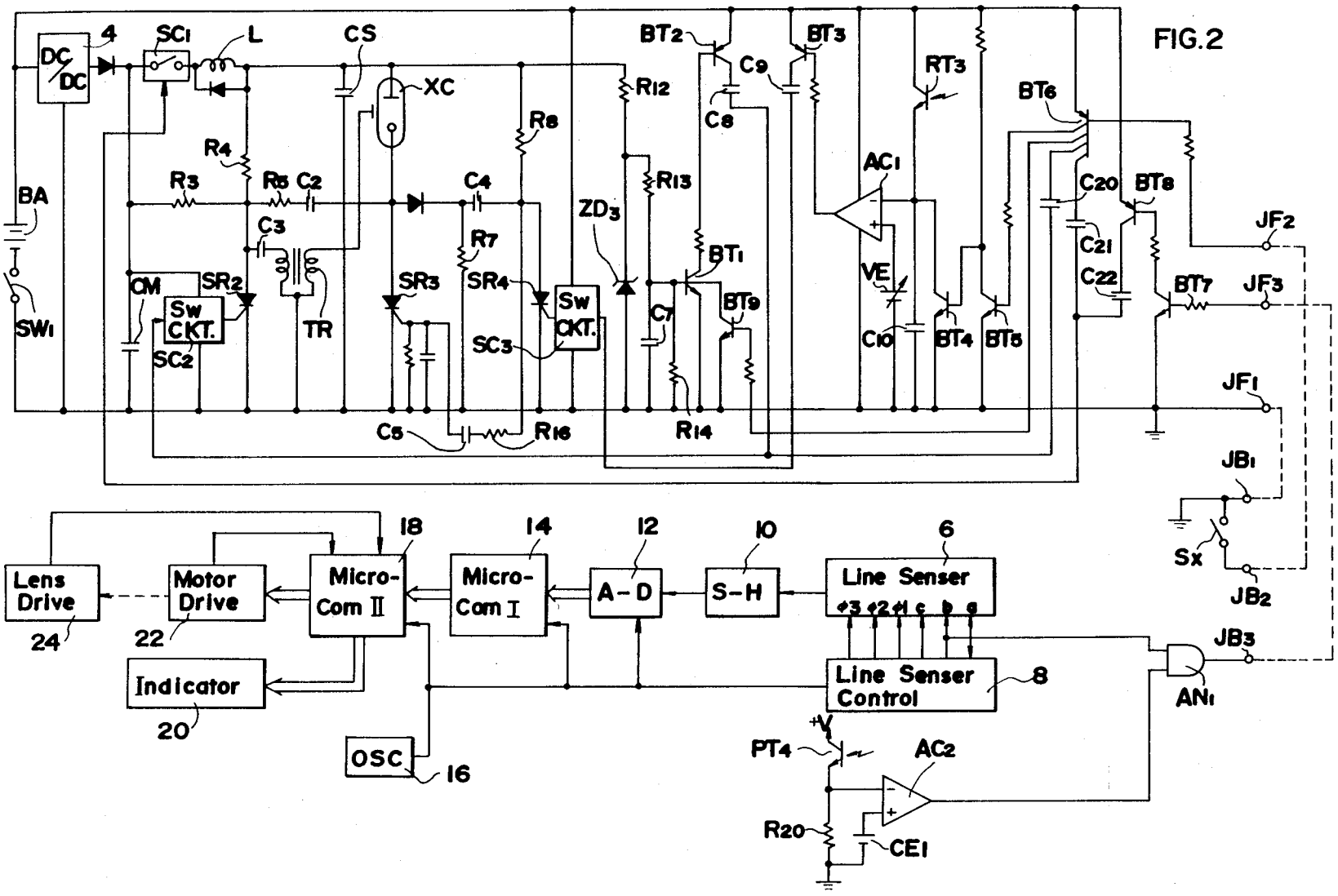

In the embodiment shown in FIG. 2, the present invention is applied to an electronic flash circuit which is associated with an automatic focusing device employing a charge coupled device (CCD) and which is adapted to emit a small amount of flash light in response to a signal generated by the automatic focusing device when the brightness of an object to be photographed is below a given level. The electronic flash circuit is shown in the upper portion of the Figure wherein the same reference characters are used for the elements that are the same as or corresponding to those of FIG. 1 and a detailed description therefore is omitted.

DC-DC converter 4 boosts the voltage of the power source battery BA to a desired high voltage e.g. 300 V. Block SC1 represents the switching circuit SC1 in FIG. 1, and block SC2 represents the switching circuit for the trigger circuit and includes resistors R1 and R2, Zener diode ZD1, capacitor C1, light emitting diode LE2 and the phototransistor PT1 in FIG. 1. Block SC3 represents the switching circuit including the light emitting diode LD3, phototransistors PT2 and so on and is adapted for triggering thyrister SR4. Transistors BT6 has four collectors which are respectively connected with the bases of transistors BT5 and BT1 directly, with the collector of transistor BT2 and switching circuit SC2 via capacitor C20 and with switching circuit SC1 via capacitor C21. The collector of the transistor BT8 is connected to the switching circuit SC1 via the capacitor C22. Transistor BT8 is parallelly connected with transistor BT6 to form an OR circuit. Terminal JF2 is connected to the base of transistor BT6 and ground terminal JF1 are adapted to be connected with the camera synchro terminals JB2 and JB1 which are connected with the synchro switch Sx in a camera. Terminal JF3 is connected to the base of transistor BT7 and is adapted to be connected with the camera terminal JB3 which is connected to the output terminal of the AND gate AN1.

The automatic focusing device includes an image sensor or line sensor 6 disposed in a plane which is optically equivalent to the film plane of the camera, in order to detect the focusing condition of the cameras object lens. The line sensor control circuit 8 is coupled with the line sensor 6 which is connected with the sample hold circuit 10. The A/D converter 12 converts the analog signals from sample hold circuit 10 into digital signals which are supplied to the micro processor 14 for logical operation. The output of microprocessor 14 is supplied to microprocessor 18 for control operations which in turn controls indicator 20 and the motor driving circuit 22. Indicator 20 indicates whether the camera objective is at an in-focus or in either a front or rear un-focused condition. The motor driving circuit 22 drives a motor which drives the objective lens driving mechanism 24 which brings the objective lens to its in-focus position. Oscillator 16 generates clock pulses which are supplied to microprocessors 14 and 18, the A/D converter 12 and the line sensor control circuit 8. Phototransistor PT4 is arranged to detect the brightness of the object to be photographed. Comparator AC2 comprares a reference voltage CE1, with the voltage across resistor R20 which is proportional to the photoelectric current generated by the phototransistor PT4. When the brightness of an object to be photographed is too low for the focus detector to detect appropriate focusing conditions, the comparator AC2 generates a "High" level voltage.

In operation, the line sensor control circuit 8 supplies reference charges to the line sensor 6 through terminal a, and provides an integration start signal through terminal b to initiate the integration in line sensor 6. The reference charge supplied through terminal a is discharged in accordance with the output of the photoelectric elements provided in line sensor 6 for monitoring the light received therefrom. The remaining charge is monitored by control circuit 8 through terminal a. When the remaining charge reaches a given value, a transfer signal is applied through terminal c to line sensor 6 which transfers the charge stored in each potential well to a shiftregister. Subsequently, voltage signals commensurate with the stored charges are output from the line sensor in response to transfer signals applied through terminals $\phi 1$, $\phi 2$ and $\phi 3$. The voltage signals from line sensor 6 are taken in by the sample hold circuit 10, converted into digital signals by A/D converter 12 and supplied to microprocessor 14 where the signals are processed to detect the focusing condition and provide output signals representative of the amount and direction of defocus i.e. how much the image formed by the objective lens is distant from a predetermined focusing plane and on which side of the plane the image is formed. Microprocessor 18 drives the lens driving motor in accordance with the data from microprocessor 14 and signals from motor driving circuit 22 and lens driving mechanism 24, while indicator 20 indicates the focusing condition.

The operations are repeated until the objective lens reaches its in-focus position.

When the brightness of an object is low and the intensity of the light incident on the photoelectric elements in line sensor 6 is low, it takes a considerable period of time from the application of a storage start signal through terminal b to the application of a transfer signal through terminal c, and accordingly it takes significant time for the focus adjustment. To cope with this problem, the second embodiment employs a comparator AC2 which generates a "High" level output when the brightness of an object is lower than the given level. The "High" level output is applied to one input of AND and opens the gate which transmits a "High" level storage start signal being applied to terminal b, to the base of transistor BT7 through terminals JB3 and JF3.

When the "High" level signal is applied to the base, transistors BT7 and BT8 are rendered conductive to turn on switching circuit SC1 so that the auxiliary capacitor CS is charged therethrough until the charging is completed and shuts off switching circuit SC1. Then, the Xenon tube Xe emits a small amount of flash light as in the case of the FIG. 1 circuit. Thus, the object is illuminated to facilitate focus detection. The small amount of flash light emission can follow the focus detection cycle and requires only a short time for the charging of the flash tube energizing capacitor, and improves the response of the focus adjustment. When the camera synchro switch Sx is closed in conjunction with shutter operation, transistor BT6, is rendered conductive to turn on the switching circuit SC1 and at the same time actuates the trigger circuit so that the Xenon tube Xe is fired and its light is controlled automatically identical with the case of the FIG. 1 circuit. It should be noted that the amount of light emitted from Xenon tube Xe may be controlled in accordance with a camera-to-object distance data given by the automatic focusing device in place of the ouput of the light measuring circuit including phototransistor RT3, capacitor C10, comparator AC1 and so on.

Figure 3:
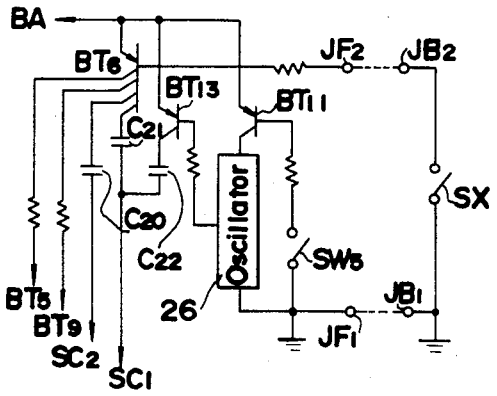
FIGS. 3 and 4 are partial circuit diagrams showing the third and fourth embodiments.

FIG. 3 shows a third embodiment which is provided with manual switch SW5 for testing or confirming the state of illumination of the flash device prior to actual picture taking. In FIG. 3, only the portion modified from the FIG. 2 circuit is shown. When switch SW5 is manually closed, transistor BT11 conducts to actuate oscillator circuit 26 which periodically conducts transistor BT13. As a result, Xenon tube Xe is repeatedly fired to emit a small amount of light at each time. Thus, the illumination condition can be observed due to the after-image effect.

Figure 4:
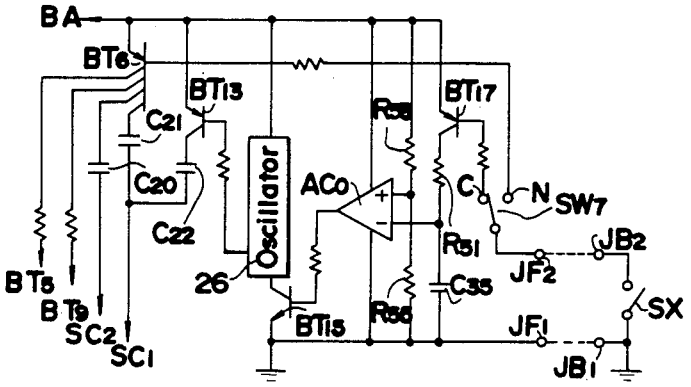

FIG. 4 shows another modification which serves as a stroboscope for successively illuminating a moving body at a high frequency as well as serving as an ordinary electronic flash device. When switch SW7 is connected to terminal c, the closure of synchro switch SX renders transistor BT17 conductive to activate oscillator circuit 26 for a period determined by the capacitance of capacitor C35 and resistance of resistor R51. During that time, transistor BT13 is repeatedly turned on and off to successively fire the Xenon tube Xe at a high frequency. When switch SW7 is connected with terminal N, transistor BT6 conducts in response to the closure of synchro switch SX and Xenon tube Xe is fired a single time with the amount of emitted light being controlled automatically by the output of the light measuring circuit.

Figure 5:
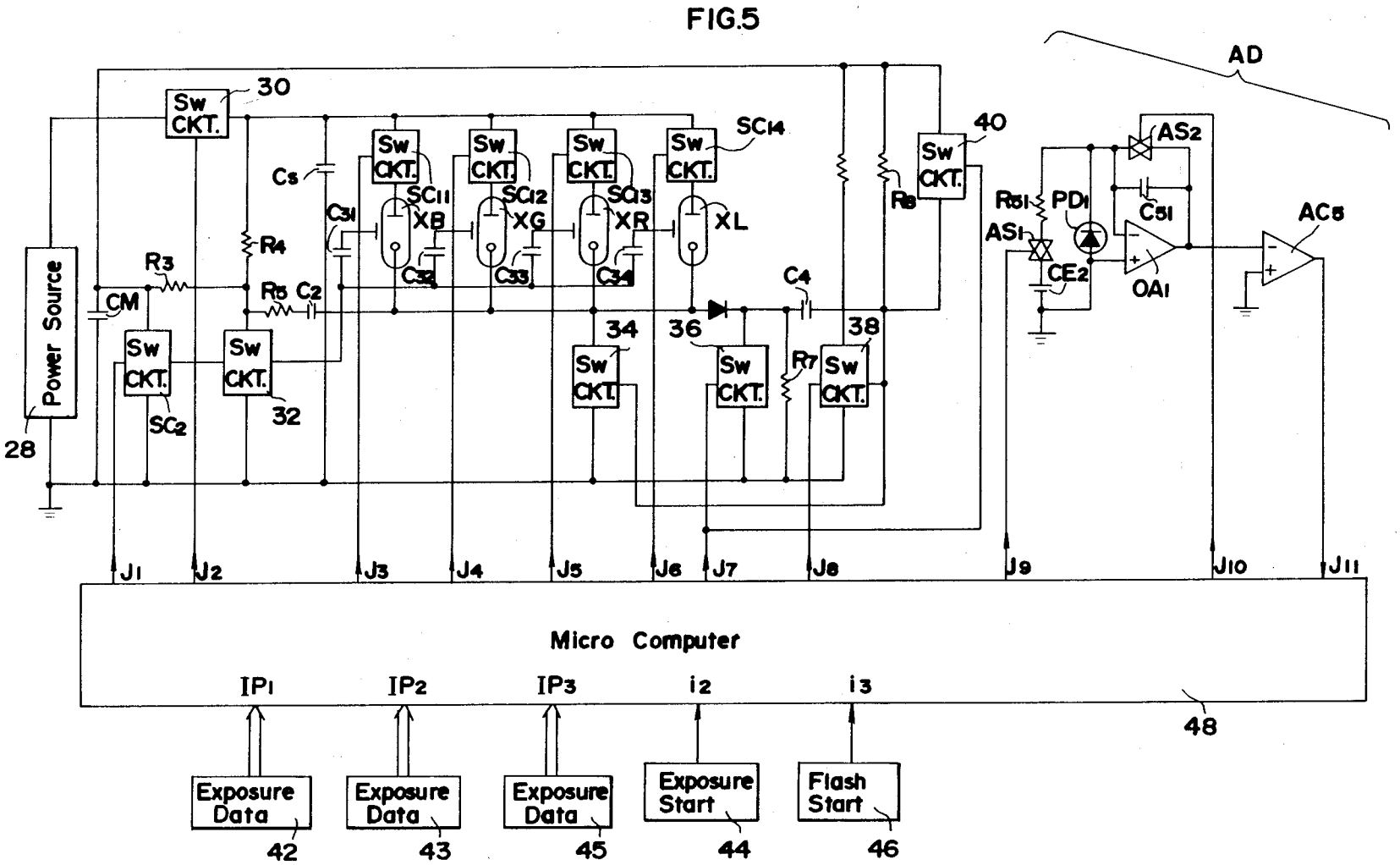
FIG. 5 is a circuit diagram showing the fifth embodiment.

FIG. 5 shows another embodiment wherein the present invention is applied to a photographic color enlarger employing electronic flash tubes for its light source. Power source circuit 28 corresponds to power source circuit 1 in FIG. 1 but, in the case where a color enlarger is used, the power is supplied from a commercial AC power source. The power source circuit 28 generates a high voltage of e.g. 300 V which is applied to main capacitor CM to charge the latter. Block 30 represents the circuit including switching circuit SC1, inductance element L and the diode connected thereacross in FIG. 2 circuit. Block 32 represents the trigger circuit including thyrister SR2, capacitor C3, trigger transformer TR and so on in FIG. 2 circuit. The output of trigger circuit 32 is connected to the trigger electrodes of Xenon tubes XB, XG, XR and XL respectively through capacitors C31, C32, C33 and C34 to apply a trigger voltage to the Xenon tubes.

Blue, green and red filters are disposed respectively in front of the Xenon tubes XB, XG and XR so that blue, green and red lights are emitted therefrom. The Xenon tube XL is adapted for the illumination of an original film and for forming its image on the easel for the purpose of trimming and/or focusing. Switching circuits SC11, SC12, SC13 and SC14 are serially connected with Xenon tubes XB, XG, XR and XL respectively and have substantially the same construction as switching circuit SC1 in FIG. 2. Those switching circuits SC11, SC12, SC13 and SC14 conduct respectively in response to the signals supplied from terminals j3, j4, j5 and j6 and selectively connect Xenon tube XB, XG, XR and XR with the capacitor CM or XS. Block 34 represents a circuit having the same structure as the circuit including thyrister SR3 and its neighboring (or associated) elements in FIG. 2 while block 38 represents a circuit having the same structure as the circuit including thyrister SR4 and its neighboring (or associated) elements in FIG. 2. Switching circuit 40 has substantially the same structure as switching circuit SC1 in FIG. 2. The circuit AD is the analog circuit portion of a dual slope A/D converter and includes photodiode PD1 for monitoring the light emitted from Xenon tubes XB, XG and XR, capacitor 51, operational amplifier OA1 and AC5, switching elements AS1 and AS2 and the constant voltage source CE2.

Microprocesser 48 is provided for controlling the light emission of Xenon tubes XB, XG, XR and XL. Exposure data supplying sections 42, 43 and 45 are coupled with microprocessor 48 to supply the latter with data concerning exposures by blue, green and red lights respectively. Block 44 represents an exposure initiation signal supplying section 44 while block 46 represents a section for generating a signal for initiating illumination by Xenon tube XL. Both sections 44 and 46 are also coupled with the microprocesser.

While section 46 is generating a "High" level signal, the microprocesser repeats an operation wherein a pulse is generated from terminal j2 and then pulses are generated from terminals j1 and j6. With this repeated operation, the Xenon tube XL is successively fired at a high frequency e.g. 50 Hz, and provides illumination for trimming, focus adjustment and determination of enlarging magnification. It should be understood that Xenon tube XL may be dispensed with by e.g. modifying microprocesser 48 such that it repeatedly generates at first a pulse from terminal j2 and then pulses from terminals j1 and j4 to successively fire the Xenon tube XG at a high frequency, thereby using Xenon tube XG for the illumination as well as for the blue light exposure.

When signal outputting section 44 generates an exposure initiation signal, microprocesser 48 determines the unit amount of light to be emitted from Xenon tubes XB, XG and XR. It should be noted that Xenon tubes XB, XG and XR are controlled to emit flash light numerous times adjusting the amount of the light to be emitted at each time i.e. the unit amount of light being determined in accordance with a desired total amount of emitted light and the sum of light amounts that have been emitted. Then, microprocessor 48 generates pulses from terminals j1, j2 and j3 to fire Xenon tube XB, and at the same time makes terminals j9 and j10 at "Low" level so that capacitor C51 integrates the photoelectric current of the photodiode PD1 which is receiving the light emitted from Xenon tube XB. When the unit amount of flash light is attained, microprocesser 48 generates a pulse from terminal j8 to actuate switching circuit 38 and interrupt the light emission of Xenon tube XB. Then, microprocesser 48 generates a pulse from terminal j7 to conduct switching circuits 36 and 40 so that stop capacitor C4 is rapidly recharged. After that, microprocesser 48 renders terminal j9 at a "High" level to discharge capacitor C56 with a constant current determined by the voltage of constant voltage source CE and the resistance of resistor R51. At the same time the microprocesser starts counting to measure time by the counted number of clock pulses until the voltage of capacitor C51 reaches zero and the potential at terminal j11 becomes a "High" level whereupon the microprocesser stops the counting. The counted value at that time corresponds to the amount of the light emitted from Xenon tube XB. The data of the light amount is substracted from the exposure data supplied from green light exposure data supplying section 42 to calculate the remaining amount of exposure to be given thereafter and also determine a unit amount of flash light to be emitted next time.

Then, microprocesser 48 makes terminal j10 at a "High" level discharge and reset capacitor CS1. Subsequently microprocesser 48 generates pulses from terminals j1, j2 and j4 to fire Xenon tube XG. When Xenon tube XG has emitted the unit amount of flash light, microprocesser 48 stops the firing of Xenon tube XG with the emitted light being monitored and integrated by the analog portion of dual slope converter AD. The integrated signal is converted into a digital signal by microprocesser 48 which then calculates the amount of light emitted from Xenon tube XC and determines the unit amount of light to be emitted from the Xenon tube XG next time. At the same time the flash stop capacitor C4 is rapidly recharged. Subsequently, microprocesser generates pulses from terminals j1, j2 and j5 to fire Xenon tube XR, for the latter, monitoring of the emitted light, interruption of the light, calculation of the amount of emitted light and the determination of the next time for emitting light from Xenon tubes XB and XG.

The above operations are repeated to fire Xenon tubes XB, XG and XR subsequently and successively a plurality of times until the remaining amounts of exposure calculated for blue, green and red light become not more than a predetermined value e.g. 2% of the previously given total amount for each color, whereupon the firing of Xenon tubes XB, XR and XG are terminated.

Figure 6:
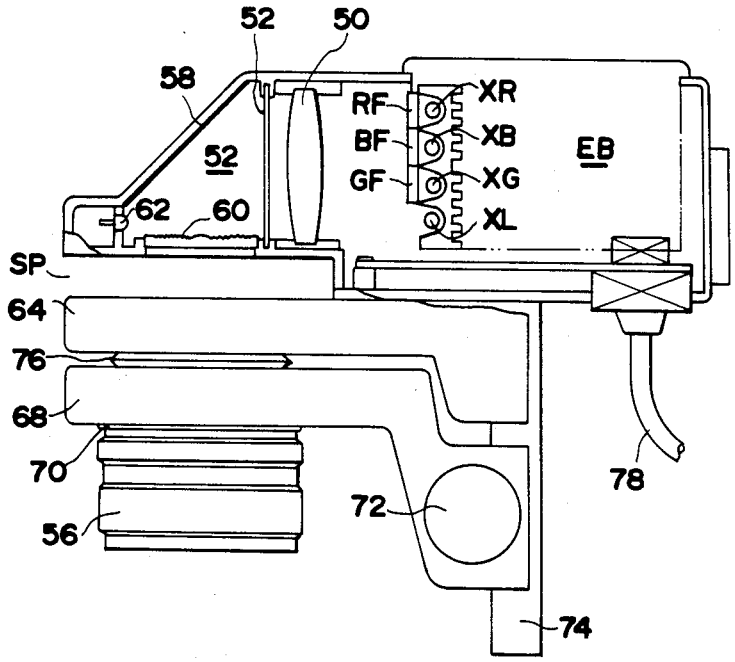
FIG. 6 is a schematic illustration of an optical system in the head of a photographic enlarger to be coupled with the embodiment shown in FIG. 5.

FIG. 6 schematically illustrates the head of a color enlarger to be associated with the circuit in FIG. 5. The head includes Xenon tubes XR, XB and XG and red, blue and green filters RF, BF and GF respectively disposed in front of the Xenon tubes so that red, blue and green lights are emitted therethrough. Xenon tube XL is adapted to emit flash light flashed repeatedly at a high frequency for continuous illumination of the original film for focusing or determination of enlarging multiplication. Block EB represents an electronic circuit for controlling the Xenon tubes and may have an arrangement as shown in FIG. 5. Condensor lens 50 converges the light from Xenon tubes XR, XB, XG and XL which are disposed substantially on the focal plane of condenser lens 50. This is so that the light rays from each Xenon tube travels in parallel with each other and with the optical axis of the lens after it has traversed the lens. Lenticular plate 54 diffuses the flash light emanating from condenser 50 to make the light as if it is emitted from a plane light source. Mixing box 52 mixes the rays of the light emanating from lenticular plate 54. Reflex mirror or reflecting plate 58 is disposed in mixing box 52 to direct the light towards projecting lens 56. At the bottom of mixing box 52 is disposed Fresnel lens 60 for converging the light in the mixing box. Photoelectric element 62 monitors the light emitted from Xenon tube XR, XB, XG and XL. Carrier support 64 supports a negative film carrier (not shown) which is to be mounted in the gap SP between Fresnel plate 60 and support 64 and which holds a negative film of which picture images are to be printed. Lens support 68 has lens mount 70 to which enlarger lens 56 is mounted. When focus adjusting nob 72 is turned, support 68 moves up or down along supporting post 74. Bellows 76 is expansively connected at its both end with carrier support and lens support 68. Electric code 78 is derived from electric circuit EB for supplying commercial AC power thereto.

Figure 7:
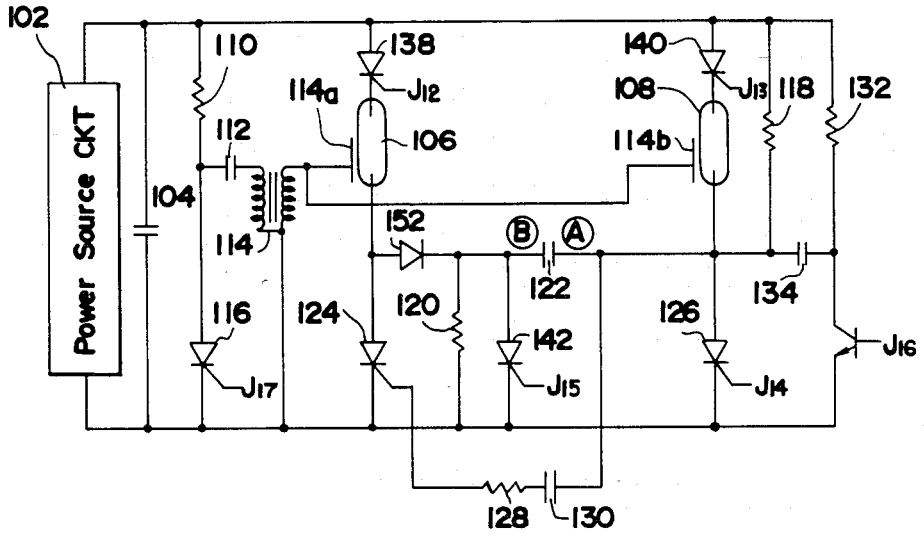
FIG. 7 is a circuit diagram showing an exemplary circuit for successively firing electronic flash tubes.

With reference to FIG. 7, power source circuit 102 includes a conventional low voltage battery and a DC/DC converter for boosting the low voltage of the battery to a desired high voltage e.g. 300 V. A high voltage layer-built battery cell may be employed in place of the power source circuit. Main capacitor 104 is charged by power source circuit 102 and stores the electric charge for energizing flash tubes 106 and 108, which may be Xenon tubes. A trigger circuit includes resistor 110, trigger capacitor 112, trigger transformer 14 and thyrister 116, and serves to apply a high voltage to the trigger electrodes **114*a* and 114*b* of flash tubes 106 and 108 and trigger the firing of flash tubes 106 and 108. Flash stop circuit for interrupting the firing of flash tube 106 comprises resistors 118 and 120, commutation capacitor 122 and thyristers 124 and 126. Resistor 128 and capacitor 130 form an initiation circuit for making thyrister 124 conductive in synchronization with the start of the firing of flash tube 106. Resistor 132, capacitor 134 and transistor 136 together make up a thyrister controlling circuit for making thyrister completely nonconductive. Thyristers 138 and 140 are connected in series with flash tubes 106 and 108 respectively and serve as semiconductor switches for selectively opening and closing the closed circuits including flash tube 106 or 108 and main capacitor 104. Thyrister 142 lowers the potential at terminal B of capacitor 122 on the side of resistor 120 to promote rapid charging of commutation capacitor 122. The gates of thyristers 116, 118, 140 and 142 and the base of transistor 136 are respectively connected with output terminals J16 through J17 of control circuit 144 in FIG. 8. And those thyristers and the transistor are controlled by electric pulses generated by control circuit 144**.

Figure 8:
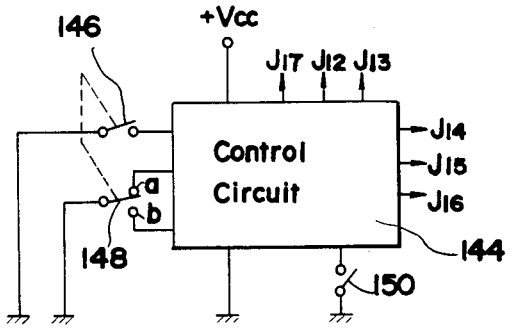
FIG. 8 is a block diagram of a control circuit for the circuit shown in FIG. 7.
Figure 9:
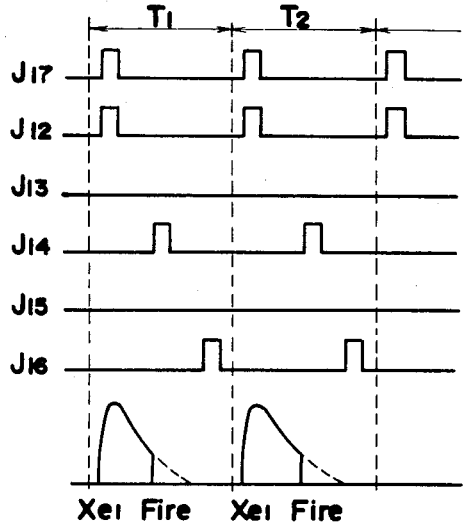
FIGS. 9(A) and 9(B) are time charts showing the time-relationship of the signals generated in the circuits of FIGS. 7 and 8.
Figure 9:
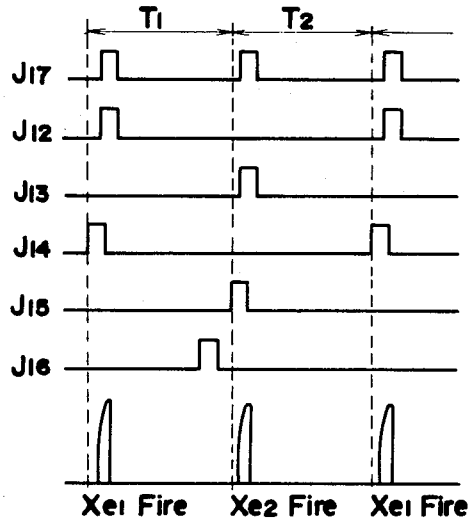

Control circuit 144 shown in FIG. 8 includes selection switch 146 for selecting either a single flash light emission mode wherein only flash tube 109 is fired a single time, and a successive light emission mode wherein flash tubes 106 and 108 are alternatively and successively fired. Switch 148 is linked with selection switch 146 such that when selection switch 146 is opened to select the single light emission mode, switch 148 is connected to terminal a for automatic flash control wherein only the flash tube 106 is fired. The light reflected from a photographic object being illuminated by the flash light is measured by a photocell. The light measurement i.e. the output of the photocell is integrated and the flash firing is interrupted when the integration attains a given level corresponding to a proper exposure for the film in the camera by the light reflected from the object when selection switch 146 is closed to select the sucessive light emission mode, switch 148 is connected to terminal b for controlling flash tubes 106 and 108 to emit the same given amount of light alternatively and successively. In this manner, switch 148 is adapted for the selection of the light control mode. Switch 150 is a synchro switch provided in the camera to be closed in synchronization with opening of the camera shutter. Although, the detail of control circuit 144 is not shown, it will be easily designed by those skilled in the art such that it generates at terminals J11 through J16 signals as shown in FIGS. 9(A) and 9(B) in response to the opening and closing of switches 146, 148 and 150. To this end, control circuit 144 may include a pulse generator, logic circuit elements and so on or may be composed of a microprocesser.

The operation of the above circuit will now be explained with respect to the single light emission mode and the successive light emission mode.

(i) Single Light Emission Mode

When the single light emission mode is selected, selection switch 146 is opened while switch 148 is connected to terminal a in linked relationship with switch 146. At the initial stage where a power source switch (not shown but may be provided in power source circuit 102) has been closed, main capacitor 104 has been charged by power source circuit 102 to a desired level, e.g. 300 V. The commutation capacitor 122 has also been charged through the path traced through resistor 118, commutation capacitor 122 and resistor 120 so that terminal A is at 300 V while terminal B is at zero volts. When synchro switch 150 is closed in conjunction with the opening of the camera shutter, control circuit 144 generates at terminals J12 to J17, signals as shown in the time chart of FIG. 9(A).

In the first period T1, thyristers 116 and 138 are made conductive by respective pulse signals generated from terminals J17 and J12 simultaneously in substance. As a result, capacitor 112 is discharged through thyrister 116 and the primary winding of transformer 114 so that a high voltage is applied to trigger electrodes 114*a* and 114*b*. As a result, the internal impedance of respective flash tubes 106 and 108 rapidly drops but only flash tube 106 connected with conducting thyrister 138 begin to flash light. The other flash tube 108 is not fired because thyrister 140 has not been conductive. With the start of firing of flash tube 106, the current discharged flows through diode 152 and resistor 120 to make the potential at terminal B of commutation capacitor 122 +300 V differentially, and the potential at terminal A 600 V. The voltage change at that time is transmitted through capacitor 130 and resistor 128 to thyrister 124 and conducts the latter thereby firing flash tube 106.

The light emitted from flash tube 106 illuminates an object to be photographed and the light reflected by the object is measured by a light measuring circuit (not shown but well-known per se) included in control circuit 144. The output of the light measuring circuit is integrated and when the integration reaches a given level, a pulse signal is generated as a light emission stop signal from terminal J14 to render thyrister 126 conductive. As a result, the potential at terminal A of commutation capacitor becomes differentially OV and the potential −300 V at terminal B so that thyrister 124 is reverse biased through diode 152 and made non-conductive. After that, the discharge current flowing through flash tube 106 is supplied through diode 152 to commutation capacitor 122 until the potential at terminal B becomes +300 V to interrupt the firing of flash tube 106. With this, an automatic flash light control for a single light emission of flash tube 106 is terminated. Subsequently, after a lapse of a given time period e.g. 10 milliseconds for the next flash firing, i.e. a lapse of a time sufficient for the flash light control, a pulse signal is generated from terminal J16 of control circuit 122 to make transistor 136 conductive. As a result, the terminal of capacitor 134 on the side of resistor 132 drops to the ground level, while the terminal of capacitor 134 on the side of resistor 118 is differentially dropped to a minus potential to apply reverse bias voltage to thyrister 126 and forcedly makes the thyrister non-conductive.

The reason why thyrister 126 is forcedly made non-conductive is as follows. Once thyrister 126 is made conductive by a pulse signal fed from terminal J14 of control circuit 144, the thyrister remains conductive and disables the next flash light control unless the current flowing through resistor 118 and thyrister 126 becomes lower than the holding current of thyrister 126. Especially, this inconvenience is significant when a small value is selected for the resistance of resistor 118 so that commutation capacitor 122 may be charged quickly thereby enabling high speed successive flash firing in the series stop type flash control system. The thyrister controlling circuit composed of resistor 132, capacitor 134 and transistor 136 is provided by avoid such inconvenience. If a large power FET or bipolar transistor is used in place of a thyrister, resistor 132, capacitor 134 and transistor 136 are dispensed with.

(ii) Successive Light Emission Mode

When the successive light emission mode is selected, switch 146 is closed manually with switch 148 being connected with terminal b. When flash synchro switch 150 is closed at the initial condition where main capacitor 104, commutation capacity 122 and other capacitors have been charged to their respective desired levels, control circuit 144 generates from its output terminals J12 to J17 pulse signals at the timing as shown in the time chart of FIG. 9(B). In the period T1, a pulse signal is generated from terminal J14 to make thyrister 126 conductive so that the potential at terminal A of commutation capacitor 122 is made 0 volt while the potential at terminal B is made −300 volts. After a short time delay therefrom, control circuit 144 generates pulse signals from terminal J17 and J12 substantially similtaneously to make thyrister 116 and 138 conductive. As described earlier, when capacitor 112 is discharged to apply a high voltage to the respective trigger electrode 114*a* and 114*b*, only the flash tube 106 connected with conducted thyrister 138 begins to emit flash light and its the discharge current flows through diode 152, commutation capacitor 122 and thyrister 126 until the potential at terminal B of commutation capacitor 122 reaches +300 volt whereupon flash tube 6 stops firing. After that, a pulse signal generated from terminal J16 makes transistor 136 conductive to reverse bias thyrister 126 with the voltage of capacitor 134 and forcedly block thyrister 126. As the result, the firing of flash tube 106 is terminated and subsequently the next period T2 begins for the firing of flash tube 108.

At the beginning of the period T2, the potential at terminal A of commutation capacitor 122 is 0 volt while the potential at terminal B is +300 volt. When flash synchro switch 150 is closed in the subsequent photography cycle, control circuit 144 generates a pulse signal from terminal J15 as shown in the same chart of FIG. 9(B). This makes thyrister 142 conductive so that the potential at terminal B of commutation capacitor B becomes differentially 0 volts while the potential at terminal A becomes −300 V and is applied to flash tube 108 as its cathode potential. With a little time delay therefrom, control circuit 144 generates pulse signals from J17 and J13 substantially simultaneously to make thyrister 116 and 140 conductive. As the result, flash tube 108 is applied with a high voltage at its trigger electrode 114*b* and the internal impedance of flash tube 108 drops rapidly to start the firing of the flash tube. The discharge current of flash tube 108 at that time flows through commutation capacitor 122 and thyrister 142 to rapidly charge commutation capacitor 122 until the potential at terminal A of the latter reaches +300 V whereupon flash tube 108 stops firing. When this firing of flash tube 108 is terminated, the firing of flash tube 106 is initiated. In this way, alternate firing of flash tubes 106 and 108 is repeated to effect successive flash firing. It is to be noted that, in the above embodiment, the successive flash light emission is effected not by the successive firing of a single flash tube 106 but by the alternate firing of two flash tubes 106 and 108 with commutation capacitor 122 being charged by the discharge current of the flash tube being fired, whereby an extremely high speed successive flash firing is attained. Additionally, the rapid charging of commutation capacitor 111 is promoted by thyrister 142 which is connected across resistor 120 connected serially with commutation capacitor 122 and which short circuits resistor 120 when commutation capacitor 120 is charged.

The high speed successive flash firing enabled by the above device can be used not only for high speed successive photography, with a motor driven camera but also for auxiliarily illuminating an object to be photographed when forcusing is controlled manually or automatically prior to actual photography. Although the embodiment of FIG. 7 has been described as an electronic flash divice for use with a photographic camera, the same circuit may be used for other illumination purposes.

Figure 10:
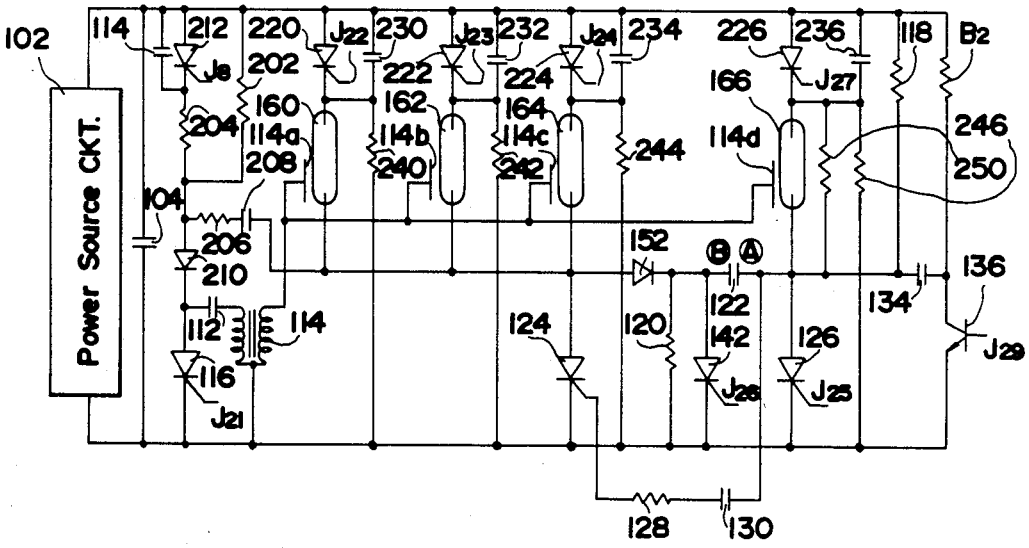
FIG. 10 is a circuit diagram showing an exemplary circuit employing the circuit construction of FIG. 7 and adapted for the light source of a photographic color enlarger.
Figure 11:
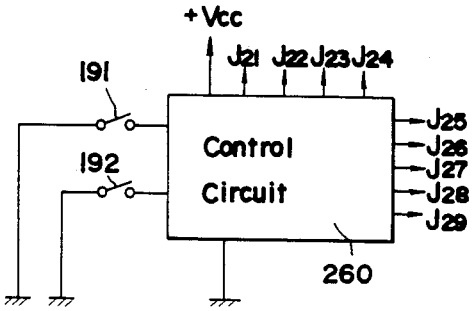
FIG. 11 is a block diagram of a control circuit for the circuit of FIG. 10.

FIGS. 10 and 11 show an electronic flash device for use as a light source of a photographic color enlarger and includes four flash tubes 160, 162, 164 and 166 and its control circuit. These flash tubes may be arranged in the head shown in FIG. 6 in place of flash tubes XB, XG, XR and XL. Flash tubes 160, 162 and 164 are coupled with blue, green and red filters. In FIG. 10, the same or like reference numerals and characters are used for the elements corresponding to those of FIG. 7. With reference to FIG. 10, power source circuit 102 includes an AC/DC converter which converts AC voltage of a commercial AC power source into DC voltage of 300 volts. Main capacitor 104 is connected across power source 102 to be charged thereby and store an electric charge to energize flash tubes 160, 162, 164 and 166. Resistors 202, 204 and 206, capacitors 208 and 112, diode 210, trigger transformer 114 and thyristers 212 and 116 together form a trigger circuit. This circuit is for applying trigger voltage from the secondary winding of trigger transformer 114 to respective trigger electrodes 114*a*, 114*b*, 114*c* and 114*d* of flash tubes 160, 162, 164 and 166 to trigger the firing of the flash tubes.

Thyrister 212 and 204 in the trigger circuit together have an impedance lower than that of resistor 202 and form a quick charging circuit for quickly charging capacitor 112 through diode 210 in the intervals between the firings of flash tubes 160, 162 and 164. Resistor 206 and capacitor 208 together form a discharge promoting circuit which promotes the discharging and firing of flash tubes 160, 162 and 164 by differentially dropping (or lowering) the cathode potential of the flash tubes to a minus potential at the time of discharge of trigger capacitor 112. Diode 210 serves as a reverse current preventing diode which prevents capacitor 212, that has been charged between the firings of flash tubes 160, 162 and 164, from being discharged through resistor 206, capacitor 208, diode 152 and resistor 120 or thyrister 142.

Thyristers 220, 222, 224 and 226 function as semiconductor switches for selectively connecting flash tubes 160, 162, 164 and 166 with main capacitor 104. Capacitors 230, 232, 234 and 236 respectively connected across thyristers 220, 222, 224 and 226 and resistors 240, 242, 244 and 246 respectively serially connected with the capacitors are provided for preventing such an erroneous operation. Thus, when a trigger pulse is applied all the flash tubes 160, 162, 164 and 166 due to the common use of the trigger circuit, the internal impedance of each flash tube greatly drops to lower the cathode potential of each thyrister and make conductive any thyrister that should not become conductive.

Capacitor 214 connected across thyrister 212 and resistor 104 serially connected with capacitor 214 together form an erroneous operation preventing circuit which prevents thyrister 212 that should not be conductive, from being made conductive by a sudden drop of its cathode potential when thyrister 116 is made conductive.

Flash firing stop circuit for forcedly interrupting the firing of flash tube 160, 162 and 164 is formed by resistors 118 and 120, commutation capacitor 122, diode 152 and thyristers 124 and 126. Resistor 128 and capacitor 130 together form an initiation circuit for making thyrister 124 conductive in synchronization with the beginning of firing of flash tube 160, 162 and 164. A circuit composed of thyrister 142 and resistor 250 and thyrister 126 respectively serves to quickly charge commutation capacitor 122. Resistor 250 has a smaller resistance than that of resistor 118. Resistor 132, capacitor 134 and transistor 130 form a thyrister control circuit for forcedly blocking thyrister 120.

The gates of thyristers 212, 116, 220, 222, 224, 226, 126 and 142 and the base of transistor 136 are respectively connected with terminals J21 to J29 of control circuit 260 shown in FIG. 11 such that the thyristers and the transistor are controlled by pulse signals fed from control circuit 260. Circuit control 260 includes selection switch 191 for selectively setting the flash control circuit to a focusing mode and a printing mode. In the focusing mode, flash tube 166 and one of flash tubes 160, 162 and 164 are alternatively fired at a high frequency to illuminate an original film and form its picture image on a easel plane substantially continuously thereby enabling confirmation of the focusing condition of the projecting lens 56 (see FIG. 6) and/or the magnification of the projected image. With such a confirmation, the operator may adjust the magnification of an enlarged image on the easel plane and the focusing of the projecting lens. In the printing mode, flash tubes 160, 162 and 164 are fired successively by a controlled amount until the sum of emitted light provides a desired amount of exposure for the printing. At this time, flash tube 166 is not energized. Switch 192 is manually closed to initiate the flash firing in each operation mode. The operation of the device shown in FIGS. 10 and 11 will now be explained.

(i) Focusing Mode

For the selection of the focusing mode, switch 191 is left open. At the initial stage where the power switch has been turned on to actuate power source circuit 102, main capacitor 104 has been charged to a given level, e.g. 300 V, sufficient to energize flash tubes 160, 162, 164 and 166. The commutation capacitor 122 has also been charged through the path tracing resistor 118, commutation capacitor 122 and resistor 120 so that the potential at terminal A is +300 V and the potential at terminal B is 0 volt. When start switch 192 is closed, control circuit 260 generates pulse signals from terminal J21 to J28 in the timings as shown in the time chart of FIG. 12(A). At first, a pulse signal is generated from terminal J25 to make thyrister 126 conductive so that the potential at terminal A becomes differentially 0 volt and the potential at terminal B become differentially −300 volts. After a short time delay, control circuit 260 generates pulse signals from terminals J21 and J22 substantially simultaneously to make thyristers 116 and 220 conductive. As the result, capacitor 112 is discharged through thyrister 116 and the primary winding of transformer 114 so that the cathode potentials of flash tubes 160, 162 and 164 are dropped differentially to −300 volts through diode 210, resistor 206 and capacitor 208 to facilitate the discharge i.e. firing of flash tubes 160, 162 and 164. At the same time, a high voltage caused at the secondary winding of transformer 114 is applied to the respective trigger electrodes 114*a*, 114*b*, 114*c* and 114*d*, causing the internal impedance of flash tubes 160, 162, 164 and 166. However, only flash tube 160 connected with unblocked thyrister 220 begins to discharge and emit flash light.

At that time, flash tubes 162, 164 and 166 will not fire since no pulse signal is generated from any of terminals J23, J24 and J27 of control circuit 260 and none of the thyristors 222, 224 and 226 is made conductive. However, the trigger voltage is applied to flash tubes 162, 164 and cause a sudden drop in their internal impedance and the cathode potentials of flash tubes 162, 164 and 166 are dropped. Hence, the cathode potentials of thyristers 222, 224 and 226 are also dropped suddenly. Such a sudden differential voltage change is likely to cause conduction of thyristers 222, 224 and 226 and accordingly fire flash tube 162, 164 and 166. To avoid such erroneous operation, capacitors 232, 234 and 246 respectively connected across thyristers 222, 224 and 226 and resistors 242, 244 and 246 serially connected with the capacitors respectively, delay with a desired time constant and slow down the potential change at the cathodes of thyristers 220,222 and 224, which will not become conductive and none of flash tubes 162, 164 and 166 may be erroneously fired.

Upon the conduction of thyrister 116, the cathode potential of thyrister 212 also suddently drops and the differential voltage change is likely to make thyristor 212 conductive. To avoid such an erroneous operation, capacitor 214 is connected across thyrister 212 and resistor 204 is serially connected with capacitor 214 so that the sudden change of the cathode potential of thyrister 212 is delayed and slowed down, whereby rhyrister 212 will not unexpectedly become conductive.

With the firing of flash tube 160, its discharge current flows through diode 152, commutation capacitor 122 and thyrister 126. And commutation capacitor 122 is charged until the potential at terminal B reaches +300 V whereupon the firing of flash tube 160 is interrupted.

Subsequently, prior to the next flash firing operation, control circuit 260 generates pulse signals from terminals J28 and J29 substantially simultaneously to make thyrister 212 and transistor 136 conductive. With the conduction of thyrister 212, capacitor 112 is rapidly charged through resistor 204 and diode 210. Through the conductive transistor 136, thyrister 126 is applied with a reverse bias voltage by capacitor 134 and is made non-conductive.

In the next period T2, control circuit 260 generates a pulse signal from terminal J26 to make thyrister 142 conductive so that the potential at terminal B of commutation capacitor 122 become differentially 0 volt while the potential at terminal A becomes −300 volt. After that, pulse signals are generated from terminals J21 and J27 of control circuit 260 to make thyristers 116 and 226 conductive. With the conduction of thyrister 116, capacitor 112 is discharged to apply a high voltage to trigger electrodes 114*a*, 114*b*, 114*c* and 114*d* so that the internal impedance of flash tubes 160, 162, 164 and 166 drop but only flash tube 166, which is connected with thyrister 266, becomes conductive and begins to emit flash light. The remaining flash tubes 160, 162 and 164 will not be fired since thyristers 220, 222 and 224 are left non-conductive.

With the firing of flash tube 166, its discharge current flows through commutation capacitor 122 and thyrister 142 to rapidly charge commutation capacitor 122 until the potential at its terminal A reaches +300 V whereupon flash tube 166 stops firing. Thus, the firing of flash tube 166 is terminated and then thyrister 212 is made conductive by a pulse signal generated from terminal J8 to rapidly charge trigger capacitor 112 for the next flash firing operation. Subsequently, firing of flash tube 160 is effected as described before. Thus, flash tubes 160 and 166 are alternatively actuated to provide successive flash light illumination.

In the above mentioned successive light emission mode, the amount of light emitted from flash tube 160 and 166 at each time is determined by the capacitance of commutation capacitor 122. Hence, flash tubes 160 and 166 emit the same amount of flash light at each time and the same amount of light is respectedly emitted. Between the firings of flash tubes 160 and 166, commutation capacitor 122 is rapidly charged by the discharge current flowing through flash tube 160 or 166 so that the time required for charging the commutation capacitor is extremely shortened thereby enabling high frequency successive flash firing.

Capacitor 112 is also charged rapidly by the current through the thyrister between firings of flash tubes 160 and 166 and can actuate the trigger circuit without delay, following the successive flash firing operation. Although flash tubes 160 and 166 are alternately fired in the present embodiment, flash tube 162 or 164 may be fired in place of flash tube 160 with thyrister 222 or 224 being selectively made conductive.

(ii) Printing Mode

For the selection of the printing mode, switch 262 is closed. When start switch 192 is closed under the initial condition wherein main capacitor 104 has been charged to a desired level, e.g. 300 V sufficient to energize flash tubes 160, 162 and 164 and commutation capacitor 122 has also been charged through the path tracing from power source 102 through resistor 118, commutation capacitor 122 and resistor 120, control circuit 260 generates pulse signals sequentially from terminals J21 through J29 in the timing shown in the time chart of FIG. 12B.

In the first period T1, a pulse signal generated from terminal J25 of control circuit 260 makes thyrister 126 conductive so that the potential at terminal A of commutation capacitor 122 becomes differentially 0 volt and the potential at terminal B becomes differentially −300 V. After a short time delay therefrom, control circuits 260 generates pulse signals from terminals J21 and J22 to make thyristers 116 and 220 conductive. As a result, capacitor 112 is discharged to lower the cathode potentials of flash tubes 160, 162, 164 and 166 to a minus level differentially through diode 210, resistor 206 and capacitor 208 to facilitate the discharge of the flash tubes. At the same time, a high voltage is applied to trigger electrodes 114*a*, 114*b*, 114*c* and 114*d* to drop the internal impedances of flash tubes 160, 162, 164 and 166 so that flash tube 160 connected with thyrister 220 that has been made conductive is fired to emit flash light. The remaining flash tubes 162, 164 and 166 are not fired since thyristers 222, 224 and 226 are non-conductive. With the firing of flash tube 160, its discharge current rapidly charges commutation capacitor 122 until the potential at terminal B of the capacitor reaches +300 V whereupon flash tube 160 stops its firing.

Then, pulse signals generated from terminals J28 and J29 of control circuit 260 make thyrister 212 and transistor 136 conductive so that capacitor 112 is rapidly charged through resistor 204 and diode 210 while thyrister 126 is applied with a reverse bias voltage differentially through capacitor 134 and is made non-conductive.

In the next period T2, control circuit 260 generates pulse signals from terminals J26 and J27 substantially simultaneously to make thyristers 142 and 226 conductive. As a result, the potential at terminal B of commutation capacitor is made 0 volt and the potential at terminal A is made −300 V differentially. Then, commutation capacitor 122 is rapidly charged by the current flowing through thyrister 226, resistor 250, commutation capacitor 122 and thyrister 142 and restores its initial condition where the potential at terminal A is +300 V while the potential at terminal B is 0 volt. During the period T2, control circuit 260 generates no pulse signal from terminal J21 and thyrister 220 remains non-conductive so that the trigger circuit is not actuated and none of flash tubes 160, 162, 164 and 166 are fired.

In the subsequent period T3, control circuit 260 generates a pulse signal from terminal J25 to make thyrister 126 conductive so that the potential at terminal A becomes differentially 0 volt and the potential at terminal B becomes differentially −300 volts. Then, pulse signals generated from terminals J21 and J23 of control circuit 260 substantially simultaneously make thyristers 116 and 222 conductive. By the conduction of thyristers 116, capacitor 112 is discharged to apply a high voltage to trigger electrodes 114*a*, 114*b*, 114*c* and 114*d* of flash tubes 160, 162, 164 and 166 but only flash tube 162 connected with thyrister 222 is fired to emit flash light. The discharge current of flash tube 162 charges commutation capacitor 122 through diode 152 until the potential at terminal B reaches +300 V whereupon flash tube 162 stops firing.

After that, control circuit 260 generates pulse signals from terminals J28 and J29 to make thyrister 212 and transistor 136 conductive thereby effecting the rapid charging of capacitor 112 and blocking of thyrister 126 as described above. In the subsequent period T4, pulse signals generated from terminals J26 and J27 of control circuit effect the rapid charging of commutation capacitor 122 in the same manner as in the former period T2. In the period T4, none of flash tubes 160, 162, 164 and 166 are fired.

Figure 12:
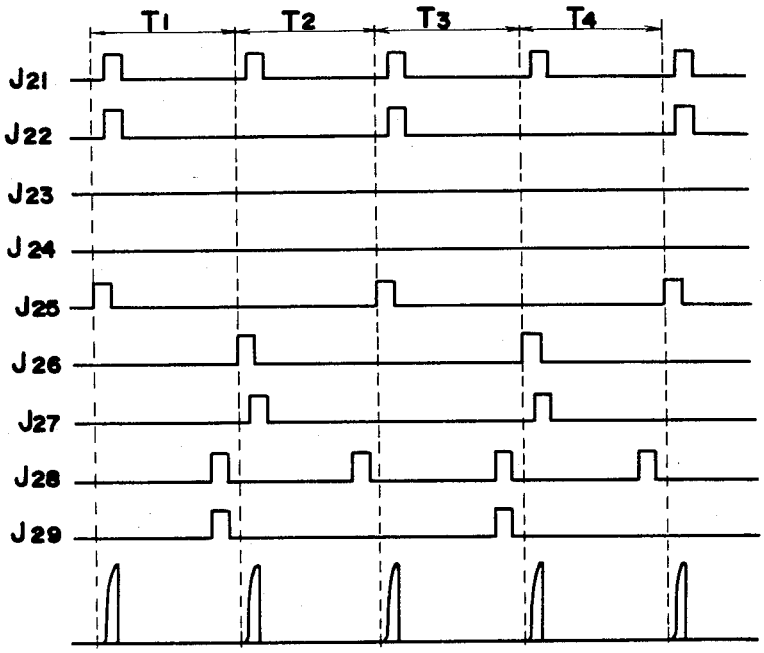
FIGS. 12(A) and (B) are time charts showing time-relationship of the singles generated in the circuits of FIGS. 10 and 11.
Figure 12:
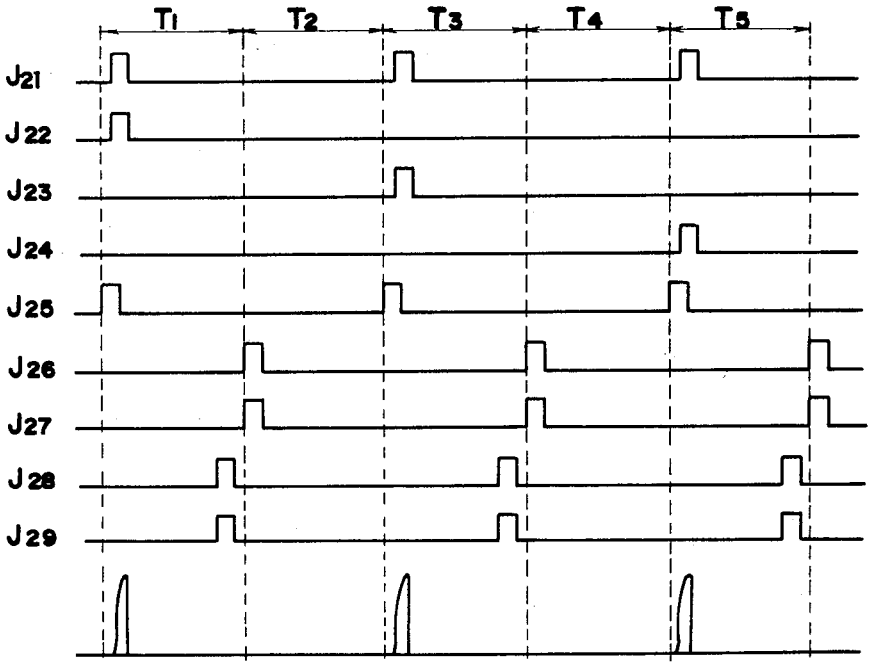

In the following period T5, control circuit 260 generates pulse signals from terminals J21, J24 and J25 at the timing shown in the time chart of FIG. 12B to effect firing of flash tube 164 connected with thyrister 224 which is made conductive by the pulse signal from terminal J24. The manner of firing of flash tube 164 is the same as those for the firing of flash tubes 160 and 162 in the periods T1 and T3. In the subsequent period, commutation capacitor 122 is rapidly charged in the same manner as in the period T2 and T4.

Subsequently, flash tubes 160, 162 and 164 are fired successively one after another until the total sums of the emitted light amounts of the respective flash tubes 160, 162 and 164 attain predetermined values, whereupon control circuit 260 stops the further firing operation. It is to be noted that in the printing mode, the total amounts of light to be emitted from the respective flash tubes 160, 162 and 164 are determined to provide a desired color balance and exposures with respective primary color light i.e. blue, red and green lights. Flash tubes 160, 162 and 164 are respectively coupled with blue, green and red filters to emit light of the primary colors. The control of the total amounts of primary color lights emitted from flash tubes 160, 162 and 164 may be made by changing the amounts of light emitted from flash tubes 160, 162 and 164 in their respective individual firing operation with the numbers of firing of each flash tube being made equal with each other. The amount of light emitted from flash tubes 160, 162 and 164 in each firing operation may be changed by changing the timing when control circuit 260 generates a pulse signal from terminal J25. Thus, if the control circuit 260 is designed to generate pulse signals from terminal J25 at different timings for flash tubes 160, 162 and 164, the flash tubes emit different amounts of light in their individual firing operation.

The total amount of light emitted from flash tubes 160, 162 and 164 may also be controlled by changing the numbers of firings of respective flash tubes with the amount of light emitted in each firing being made equal. The number may be determined in such a manner that a number of firings of one of the flash tubes is determined in accordance with its desired total amount of emitted light and then the number for the other two flash tubes are determined to provide the desired ratio of the amount of emitted light. When the output impedance of the output terminals of control circuit 260 do not conform with the input impedance of the thyristers for the light emission control of the flash tubes, photo-thyristers may be employed in place of the thyrister, with the photo-thyristers being coupled with LEDs controlled by the pulse signals from the control circuit.

Having described our invention as related to the embodiments shown in the accompanying drawing, it should be understood that the invention be not limited by any of the details of description unless otherwise specified, and that various changes and modification may be made in the invention without departing from the spirit and scope thereof.

What we claim is:

1. An electronic flash device comprising:

a power source circuit for generating a high voltage;

a main capacitor connected with said power source circuit to be charged by the high voltage;

a first flash tube coupled with the main capacitor;

a first switch element connected in series with the first flash tube;

a commutation capacitor;

a charge circuit for charging the commutation capacitor;

a second flash tube connected in parallel with the charge circuit;

a second switch element capable of bringing the first switch element into a nonconductive state when made conductive;

selecting means for selectively bringing the first and second flash tubes into a condition in which the selected flash tube is capable of emitting light; and control means for, in a first condition, simultaneously actuating the first flash tube and the first switch element, and actuating the second switch element when a predetermined light amount has been emitted, and in a second condition, alternatively actuating both of the first flash tube and the second switch element, and both of the second flash tube and the first switch element.

2. An electronic flash device as claimed in claim 1 further comprising two other flash tubes respectively coupled with said first flash tube in the same manner as said second flash tube, and wherein three of the flash tubes are respectively coupled with color filters with different color transmission characteristics to emit different color lights.

3. An electronic flash device as claimed in claim 2 further comprising means for sequentially actuating said flash tubes.

* * * * *